US009073233B2

(12) United States Patent
Cholewczynski

(10) Patent No.: US 9,073,233 B2
(45) Date of Patent: Jul. 7, 2015

(54) DEBARKER SYSTEMS WITH ADJUSTABLE RINGS

(75) Inventor: Marek Cholewczynski, Victoria (CA)

(73) Assignee: Nicholson Manufacturing Ltd., Sidney, British Columbia, CA (US)

( * ) Notice: Subject to any disclaimer, the term of this patent is extended or adjusted under 35 U.S.C. 154(b) by 1072 days.

(21) Appl. No.: 13/149,719

(22) Filed: May 31, 2011

(65) Prior Publication Data

US 2012/0305137 A1 Dec. 6, 2012

(51) Int. Cl.
*B27L 1/08* (2006.01)

(52) U.S. Cl.
CPC ..... *B27L 1/08* (2013.01)

(58) Field of Classification Search
CPC ..... A01G 23/095; A01G 23/097; B27L 1/00; B27L 1/005; B27L 1/08; B27L 1/10
USPC ..... 144/208.1, 208.4, 208.8, 208.9, 208.91
See application file for complete search history.

(56) References Cited

U.S. PATENT DOCUMENTS

| | | | | |
|---|---|---|---|---|
| 2,779,363 | A | 1/1957 | Laughton | 144/208 |
| 2,788,034 | A | 4/1957 | Brundell et al. | 144/208 |
| 2,798,519 | A | 7/1957 | Hansel | 144/208 |
| 2,799,304 | A | 7/1957 | Stewart | 144/208 |
| 2,821,220 | A | 1/1958 | Nicholson | 144/249 |
| 2,829,500 | A | 4/1958 | Butler | 60/54.6 |
| 2,927,431 | A | 3/1960 | Pitts | 60/54.5 |
| 3,137,329 | A | 6/1964 | Smith | 144/208 |
| 3,190,327 | A | 6/1965 | Robbins | 144/208 |
| 3,361,168 | A | 1/1968 | Brown | 144/208 |
| 3,532,443 | A | 10/1970 | Johnson | 417/367 |
| 3,552,456 | A * | 1/1971 | Johansson | 144/208.8 |
| 3,624,802 | A | 11/1971 | Ripert | 251/31 |
| 3,770,030 | A | 11/1973 | Palfy | 144/2 Z |
| 3,789,893 | A | 2/1974 | Carson et al. | 144/208 E |
| 3,913,644 | A | 10/1975 | Braun | 144/208 E |
| 3,970,126 | A | 7/1976 | Allen | 144/208 E |
| 3,991,800 | A | 11/1976 | Palmquist | 144/208 E |
| 4,122,877 | A | 10/1978 | Smith et al. | 144/208 E |
| 4,303,111 | A | 12/1981 | Neville | 144/2 R |
| 4,402,353 | A | 9/1983 | Pousette | 144/208 E |
| 4,403,538 | A | 9/1983 | Rise | 92/94 |
| 4,502,673 | A | 3/1985 | Clark | 267/64.24 |
| 4,519,429 | A | 5/1985 | Dreese | 144/3 R |
| 4,566,371 | A | 1/1986 | Jorgensen et al. | 92/92 |
| 4,657,056 | A | 4/1987 | Hutson | 144/208 E |
| 4,844,201 | A | 7/1989 | Ackerman | 184/6 |
| 5,117,881 | A | 6/1992 | Simpson | 144/341 |
| 5,472,027 | A | 12/1995 | Ackerman | 144/208 E |
| 6,457,499 | B1 | 10/2002 | Pousette | 144/208.8 |

* cited by examiner

*Primary Examiner* — Shelley Self
*Assistant Examiner* — Matthew G Katcoff
(74) *Attorney, Agent, or Firm* — Seed IP Law Group PLLC

(57) ABSTRACT

Apparatuses, systems, and methods for debarking logs are shown and described. The disclosed embodiments can be easily adjusted to process different logs. Air-cell rings provide for a wide range of force gradients to process both large and small diameter logs. The rings include force gradient adjustment mechanisms configurable to provide different force gradients to process logs.

20 Claims, 13 Drawing Sheets

DEBARKER SYSTEMS WITH ADJUSTABLE RINGS

BACKGROUND

1. Technical Field

The present disclosure generally relates to debarker systems, and more specifically to mechanical ring debarkers.

2. Description of the Related Art

Rotary log debarkers, commonly referred to as ring debarkers, are used to remove bark to process logs into lumber and other wood products. Rotary log debarkers often have an array of swing arms pivotally mounted to a rotatable ring. Each of the swing arms has a knife. As a log moves towards an opening of the ring, the advancing log contacts and pushes against the swing arms carried by the rotating ring. The log drives the swing arms outwardly until the knives engage the periphery of the log. The knives are urged against the log to scrape off bark.

Rotary log debarkers are typically either air-seal debarkers in which fluid pressure is maintained between the ring and an external fluid source during debarking or air-cell debarkers which are fluidically isolated from an external fluid source during debarking. Air-seal debarkers often have external fluid sources in the form of air compressors capable of delivering pressurized air to air actuators carried in a ring. The air actuators are connected to the swing arms processing the logs. The force exerted by the knives on logs can be changed on the fly by adjusting the air pressure in the actuators. For the air seal ring to operate properly, fluid communication has to be maintained between the external air compressor and the actuators. Components at the interface of the rotating and stationary parts of the ring are susceptible to failure where there is a lack of proper lubrication. Such a failure can be expensive and can result in significant machine down time. For example, significant amounts of frictional heat can be generated between seal components sliding along one another. This heat can lead to seal damage (e.g., degradation at the interface of seal components), unwanted leaking of air, and ultimately failure of seal components.

Air-cell debarkers often have rotatable rings with lightweight air bags for actuating swing arms. Air-cell rings have no air seal components so they can be rotated at relatively high rotational speeds. Each air bag is connected to a lever arm installed on a pivoting shaft carrying a swing arm. When a log enters the debarker, an end of the log strikes and moves the swing arms outwardly. The bags are compressed as the swing arms rotate. The compressed air bags exert a force to actuate the swing arms inwardly even though the air bags are not in fluid communication with an external fluid source. Air-cell rings often provide nonlinear debarking forces versus displacement, thereby providing a force gradient suitable for removing different amounts of bark from logs of different sizes, since bark thickness is often related to log diameters. Unfortunately, conventional air-cell rings are not adjustable so as to provide different force gradients. Thus, air-cell debarkers often properly debark logs having a particular diameter but improperly debark logs of other sizes because a single force gradient may not be suitable to process logs with significantly different diameters.

BRIEF SUMMARY

At least some disclosed embodiments are directed to debarker systems that can be conveniently adjusted to provide different debarking force gradients to process logs, including both large and small diameter logs. A debarker system can include an air-cell ring with swing arm assemblies actuated by force gradient adjustment mechanisms configurable to provide the different force gradients.

At least some embodiments are directed to a debarker capable of providing different force gradients for debarking logs of different sizes. Inflatable actuation devices are configured to actuate swing arm assemblies and are fluidically coupled to corresponding adjustable volume reservoir devices within a ring. The actuation devices and adjustable volume reservoir devices can be selectively isolated from an external source of pressurized fluid used to periodically pressurize the activation devices. The force, which is applied by the swing arm assemblies to different diameters of logs, is controlled by adjusting the volumes of the reservoir devices.

The debarker, in some embodiments, can be adjusted to minimize, limit, or substantially eliminate under-debarking (e.g., unwanted bark left on the logs), over-debarking (e.g., an excessive usable fiber removed with the bark), inconsistent debarking (e.g., varying applied pressures for logs having the same diameter), or the like. An initial pressure in the inflatable actuation devices can be set using an external fluid source. Small diameter logs can be processed. The pressure in the actuation devices can be adjusted (e.g., using the fluid source) until the small diameter logs are properly debarked. Larger diameter logs can be debarked. If the larger logs are under-debarked or over-debarked, pressure in the actuation devices can be decreased or increased using the adjustable volume reservoir devices. This adjusts the pressure applied by the swing arm assemblies to the large logs and allows fine tuning. Any size log between the small and large logs can be processed with a force that is generally proportional to the established force gradient, thus ensuring proper debarking. This process can be repeated to process different species of logs.

In some embodiments, a debarking apparatus includes a swing arm assembly and an air-cell ring carrying the swing arm assembly. The air-cell ring defines an opening for receiving a log and includes a force gradient adjustment mechanism coupled to the swing arm assembly. The force gradient adjustment mechanism includes a biasing device configured to be compressed as the swing arm assembly moves away from a closed position towards an open position. A force setting reservoir device is fluidically coupled to the biasing device. The force setting reservoir device is reconfigurable to change a debarking force gradient. The debarking force gradient corresponds to forces applied by a debarking tool to logs having different diameters while the biasing device and the force setting reservoir device cooperate to urge the debarking tool against the logs.

In yet further embodiments, a debarking apparatus includes a swing arm assembly having a debarking tool. A ring carries the swing arm assembly. The ring has one or more means for adjusting a force gradient of the forces applied by the swing arm assemblies to logs. The means for adjusting force gradients can include at least one biasing device and at least one force setting reservoir device. The force setting reservoir device can be an air bag, air cylinder, or the like.

A debarking apparatus, in some embodiments, comprises a swing arm assembly including a debarking tool and a ring to which the swing arm assembly is rotatably coupled. The ring includes a force gradient adjustment mechanism configured to alter forces applied by the debarking tool to logs having different diameters. In certain embodiments, the force gradient adjustment mechanism is reconfigurable to provide different force gradients. The difference between the first force gradient and the second force gradient can be at least about 10%, 20%, or 30% for different log dimensions (e.g., diameter). This allows processing flexibility. In certain embodiments, a debarking force gradient can be equal to or greater than about 38% or equal to or smaller than about 10%. The force gradient can be based on the debarking force for debarking a small diameter log and a maximum force being exerted on logs.

Some methods include pressurizing actuation mechanisms in a debarker ring. The actuation mechanisms operate swing arm assemblies to debark logs (e.g., small logs with diameters of about 5 inches). The pressure in the actuation mechanisms can be increased or decreased until desired processing is achieved. Larger diameter logs are then debarked. Reservoir devices are used to adjust a force gradient provided by the swing arm assemblies to achieve the desired processing of the larger logs. Intermediate sized logs are processed using the resulting force gradient.

DETAILED DESCRIPTION

The present detailed description is generally directed towards adjustable debarkers. Many specific details of certain exemplary embodiments are set forth in the following description to provide a thorough understanding of such embodiments. One skilled in the art, however, will understand that the disclosed embodiments may be practiced without one or more of the details described in the following description. The debarker components, such as rings and actuation mechanisms, are disclosed in the context of air-cell debarkers because they have particular utility in this context. However, the rings, actuation mechanisms, and other features can be used in other contexts. For example, the actuation mechanisms can be used to move other types of arms or other rotatable components that may or may not process logs, lumber, or the like.

Figure 1:
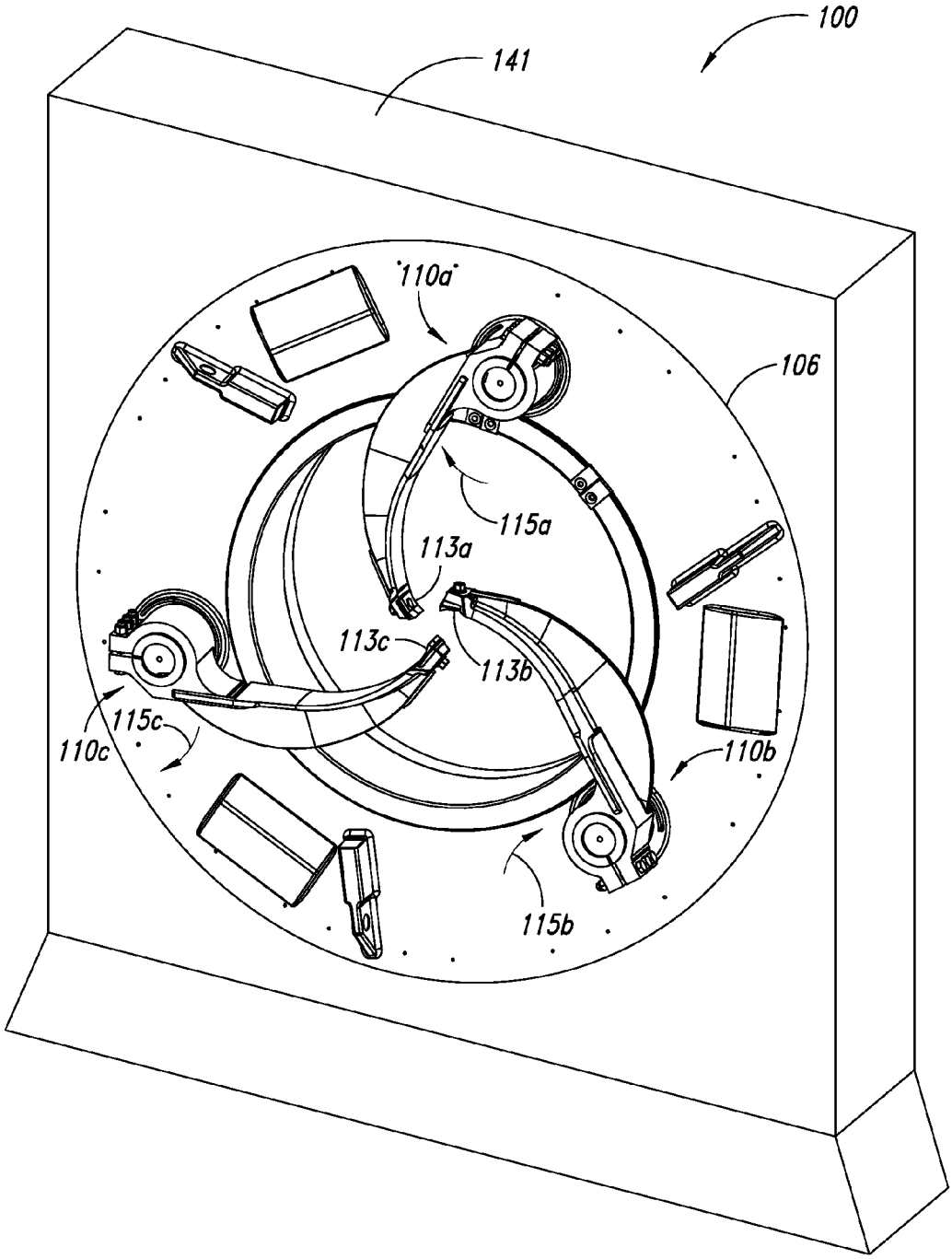
FIG. 1 is an isometric view of a debarker apparatus.
Figure 2:
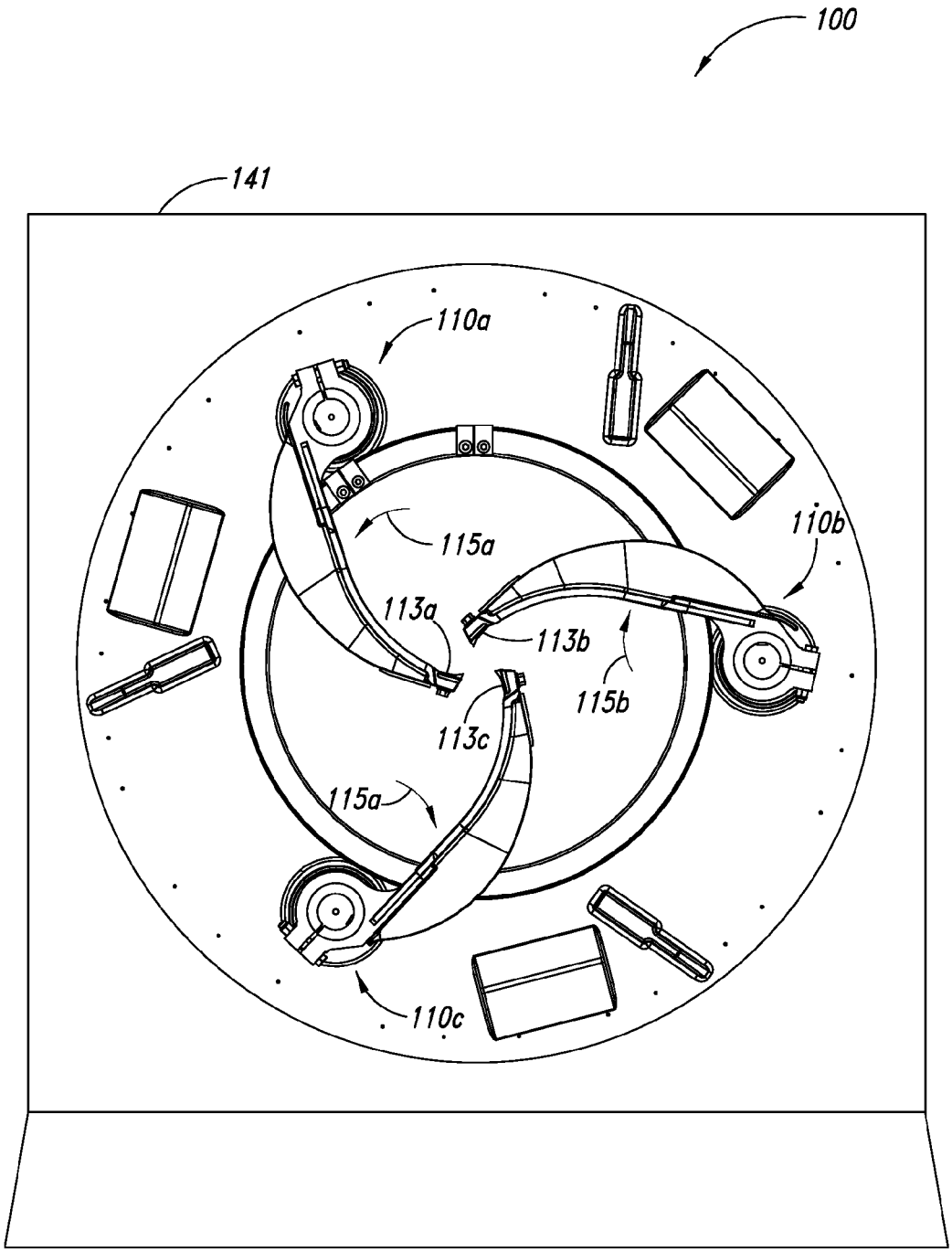
FIG. 2 is a front elevational view of the debarker apparatus of FIG. 1.

FIGS. 1 and 2 illustrate an air-cell debarker apparatus 100 that includes a rotatable ring 106 and swing arm assemblies 110*a-c* (collectively "110"). The swing arm assemblies 110 surround a processing line and include debarking tools 113*a-c* (collectively "113"). The swing arm assemblies 110*a-c* can rotate outwardly, as indicated by arrows 115*a-c*, as the ring 106 rotates about a log. The debarking tools 113 are held against a log to process (e.g., scrape, cut, roughen, combinations thereof, or the like) the log's outer surface.

Figure 3:
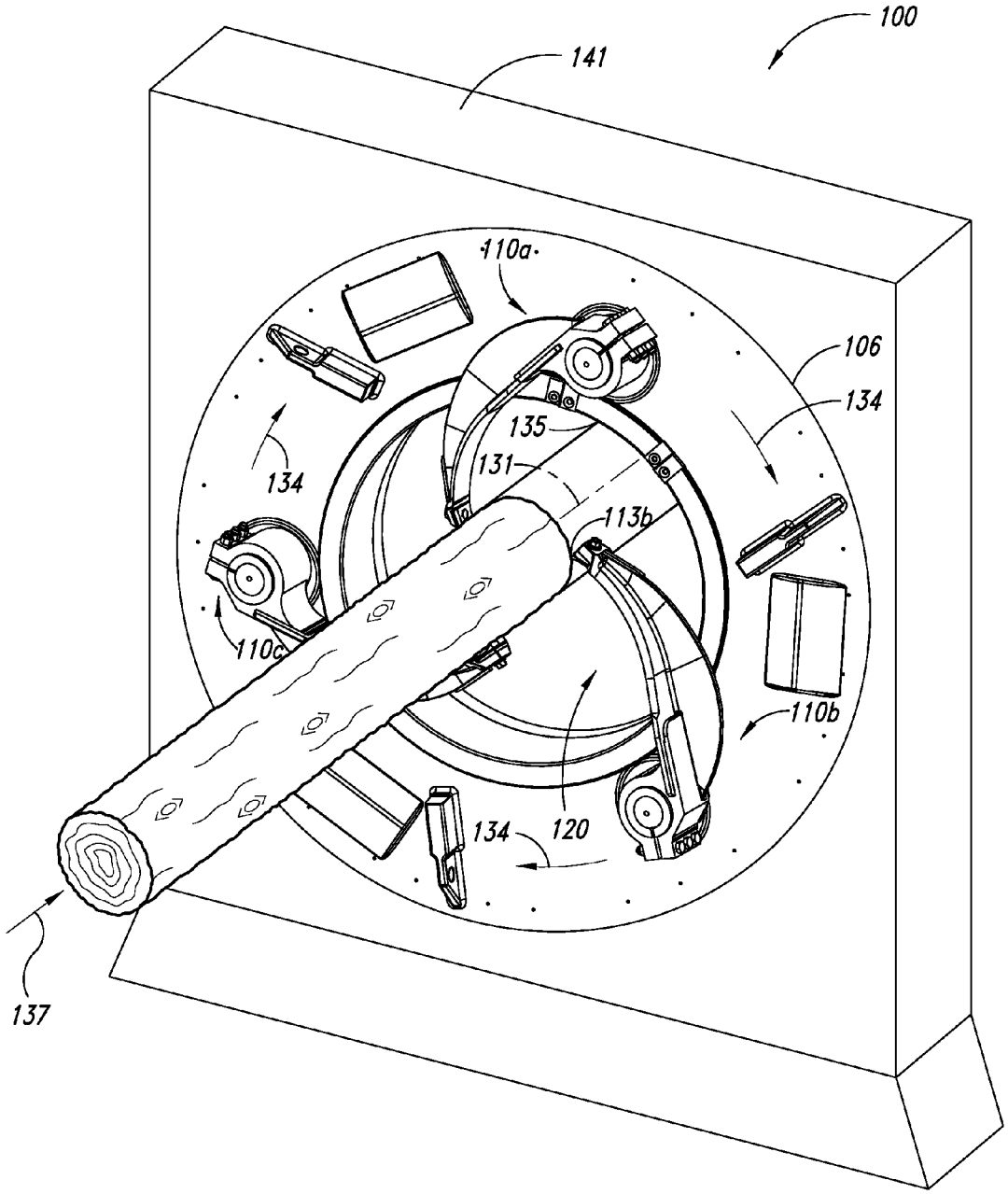
FIG. 3 is an isometric view of the debarker apparatus of FIG. 1 with swing arm assemblies surrounding a log.
Figure 4:
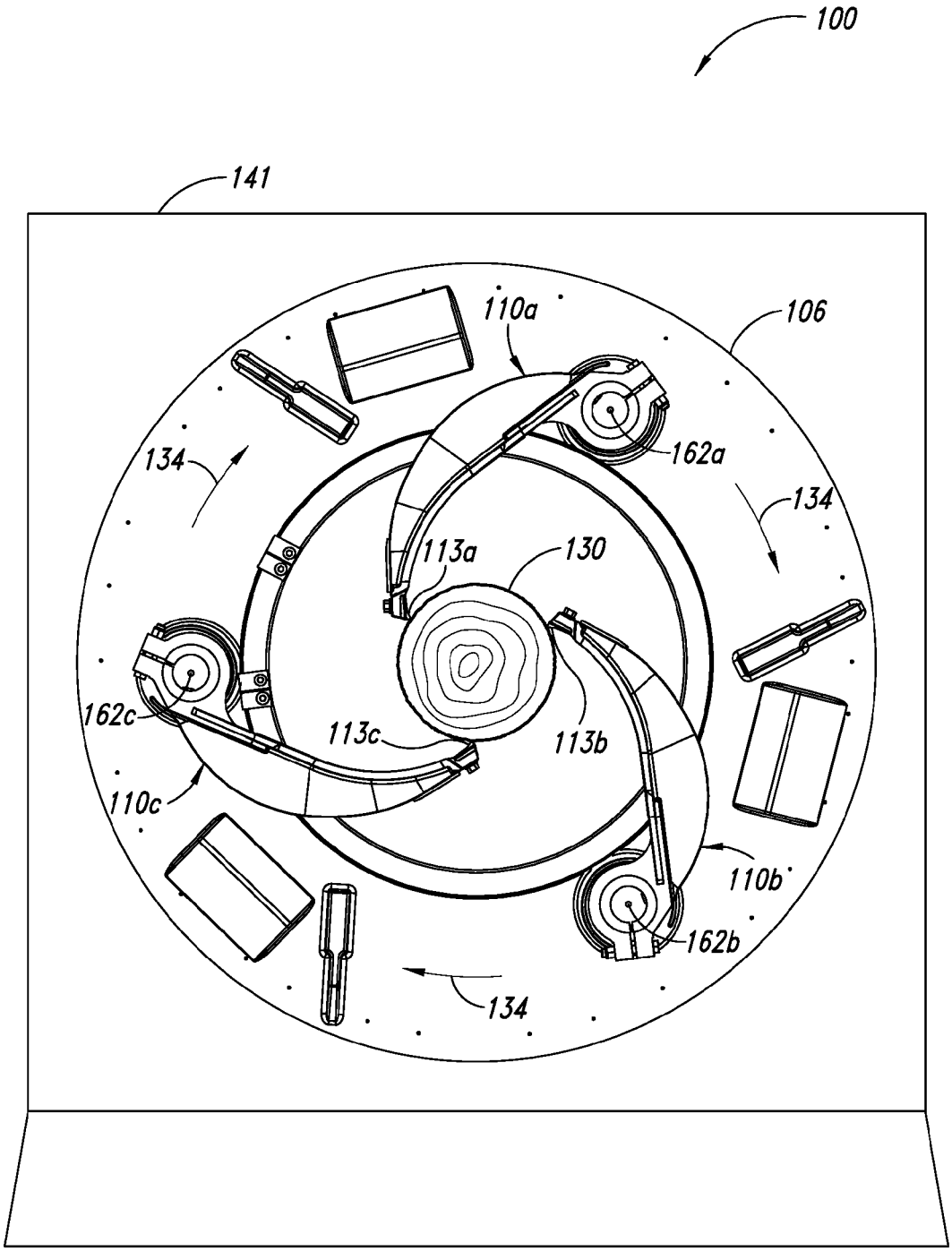
FIG. 4 is a front elevational view of the debarker apparatus of FIG. 1 with swing arm assemblies surrounding the log.

A log can be transported lengthwise along a processing line 131 of FIG. 3, as indicated by an arrow 137, towards a ring opening 120. A drive apparatus in the form of a stationary frame 141 imparts rotary motion to the ring 106 while an end 135 of a log 130 comes into contact with the swing arm assemblies 110. The swing arm assemblies 110 can slide spirally outward along the end 135 until the debarking tools 113 surround and engage the log's exterior surface. FIGS. 3 and 4 show the debarking tools 113 removing bark while the ring 106 and swing arm assemblies 110 rotate in the clockwise direction (indicated by arrows 134). The debarking tools 113 can be knives, scrapers, or other types of components suitable for processing logs and can be removably coupled to the ends of main bodies of the swing arm assemblies 110. Alternatively, debarking tools 113 can be integrally formed with the main bodies of the swing arm assemblies 110.

Figure 5:
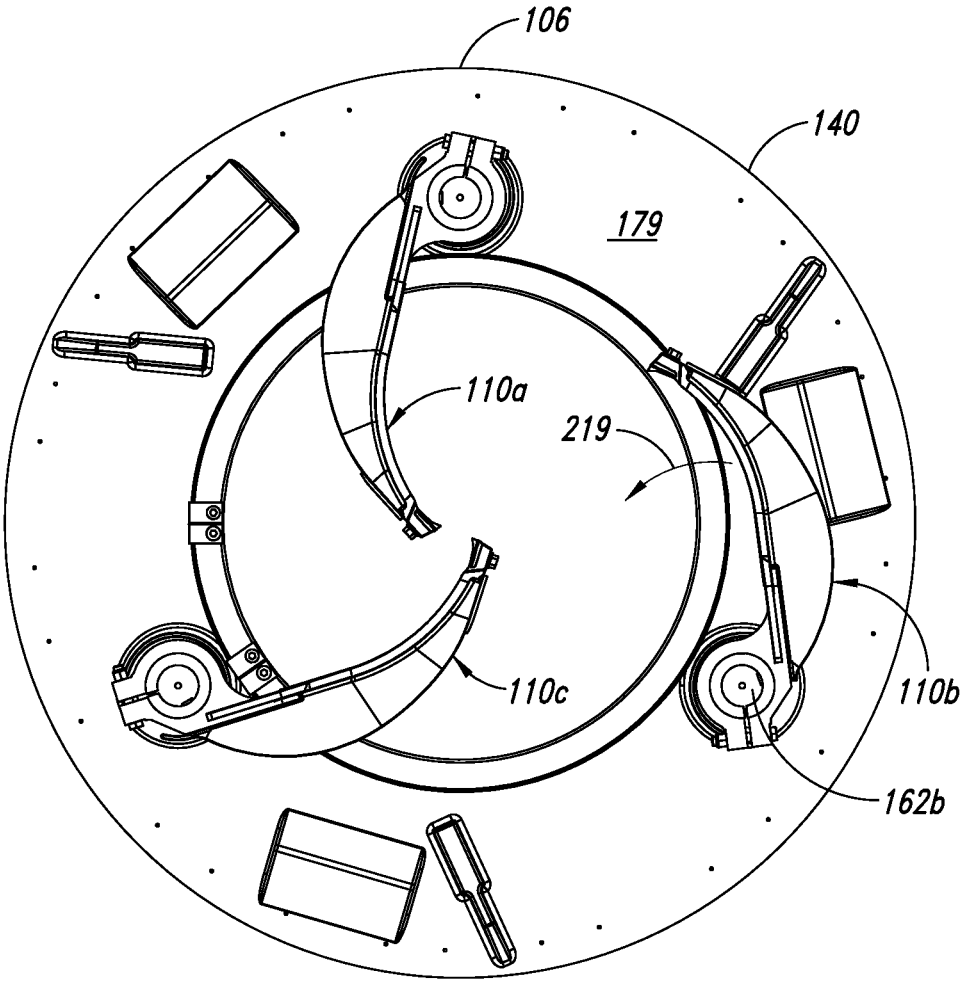
FIG. 5 is a front elevational view of a debarker ring having two swing arm assemblies in closed positions and one swing arm assembly in an open position.
Figure 6:
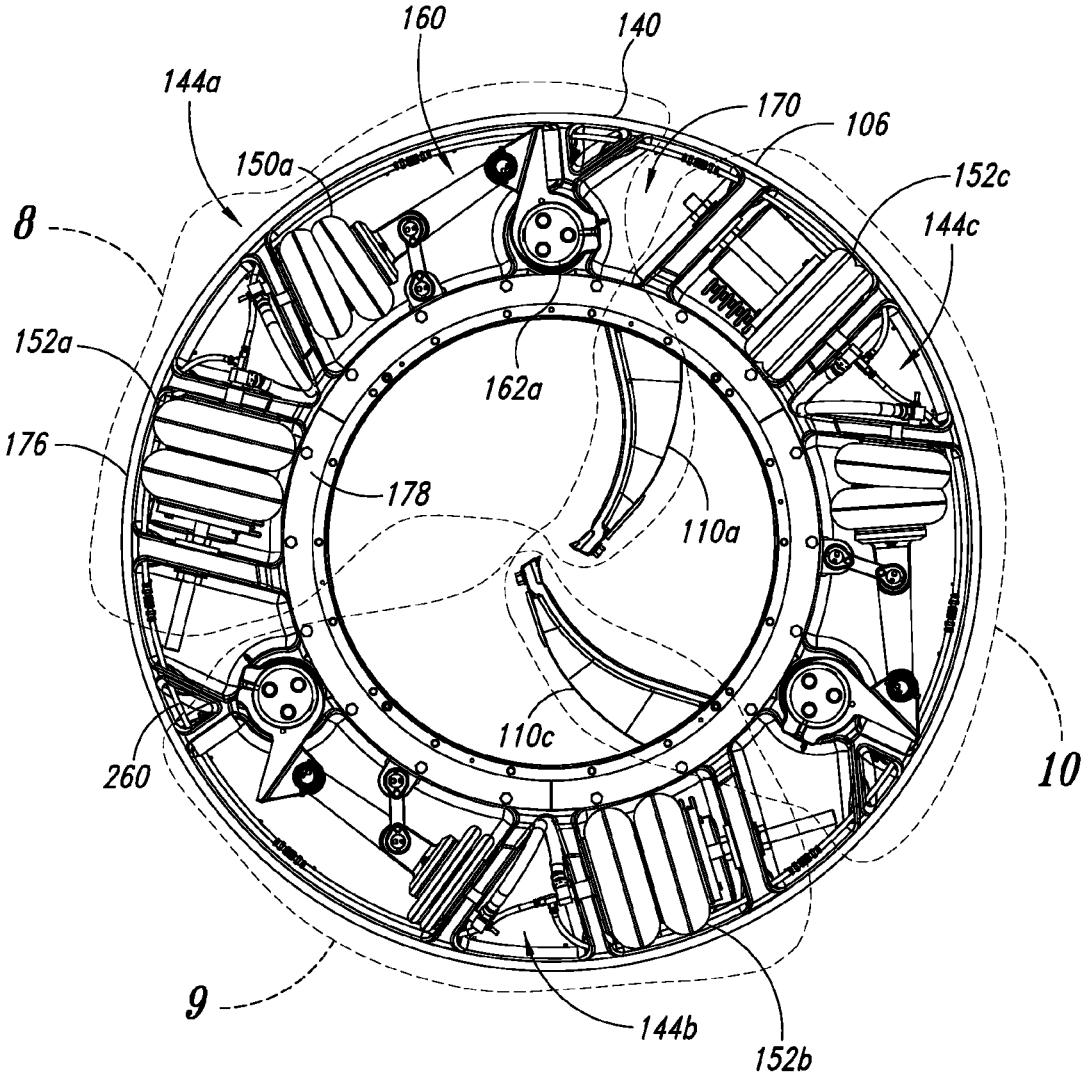
FIG. 6 is a back elevational view of the debarker ring of FIG. 5.
Figure 7:
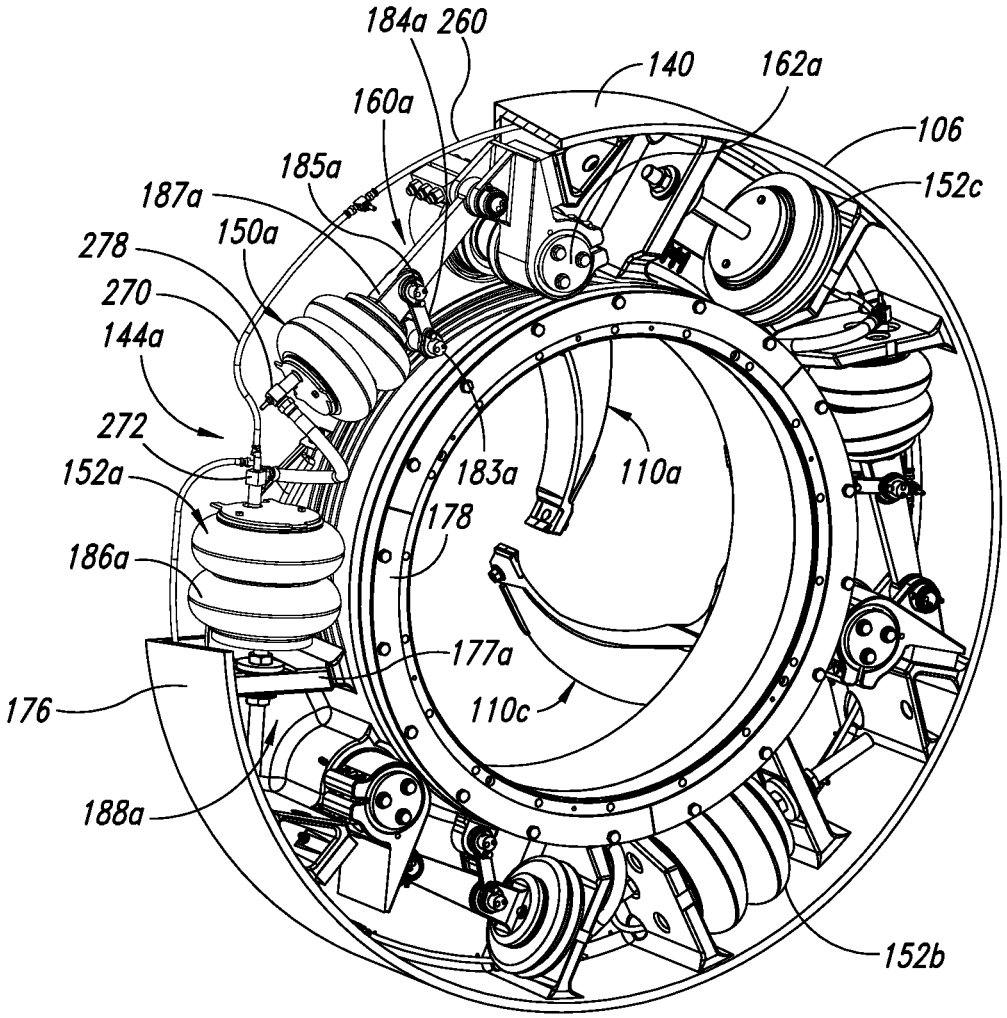
FIG. 7 is a rear, top, and left side isometric view of the debarker ring of FIG. 5 with a portion of a housing shown removed.

FIGS. 5-7 show the air-cell ring 106 including a housing 140 (shown partially cut away in FIG. 7) and circumferentially spaced apart actuation mechanisms in the form of force gradient adjustment mechanisms 144*a-c* (collectively "144"). The adjustment mechanisms 144 can adjust the force gradient of forces applied by the debarking tools 113 to logs. The adjustment mechanisms 144, as shown in FIG. 6, are positioned in a housing cavity 170 and located between outer and inner walls 176, 178. An annular front plate 179 (see FIG. 5) extends between the walls 176, 178.

Figure 8:
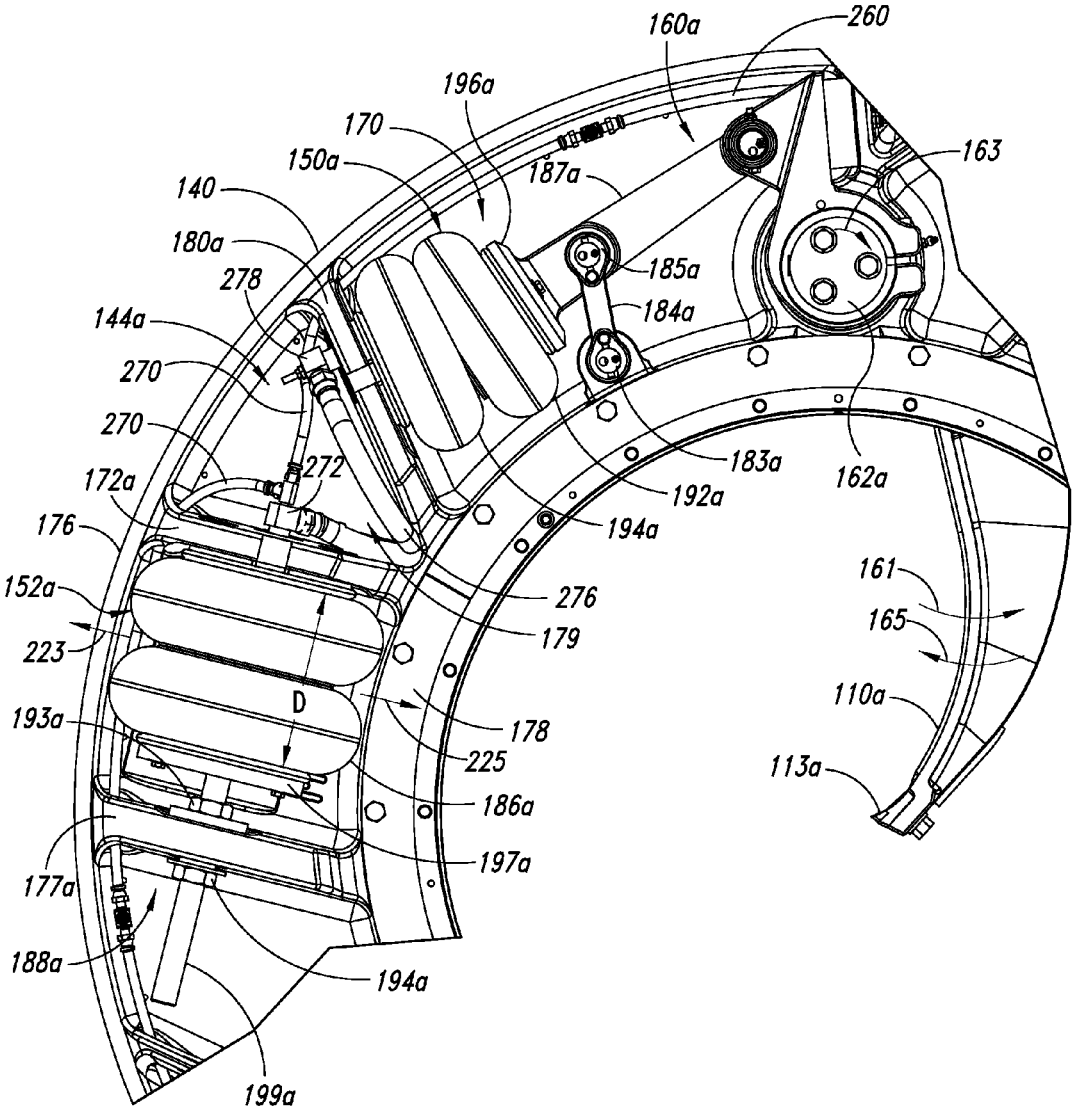
FIG. 8 is a detailed view of a force gradient adjustment mechanism of FIG. 6.

Referring to FIGS. 7 and 8, adjustment mechanism 144*a* includes a biasing device 150*a* and a force setting reservoir device 152*a* fluidically coupled to the biasing device 150*a*. The biasing device 150*a* is coupled to an interior wall 180*a* (shown removed in FIG. 7). The reservoir device 152*a* includes an inflatable device in the form of an inflatable reservoir 186*a*, illustrated as an inflatable bag, coupled to an interior wall 172*a* and an inflation limiter 188*a* coupled to another interior wall 177*a*. A pivot mechanism 183*a* pivotally couples a link 184*a* to the housing 140. An arm pivot mechanism 185*a* pivotally couples the link 184*a* to a lever arm 187*a*.

A lever mechanism 160*a* is coupled to a shaft 162*a* carrying the swing arm assembly 110*a*. Rotation of the swing arm assembly 110*a* away from the closed position, as indicated by an arrow 161 of FIG. 8, causes compression of the biasing device 150*a*. The compressed biasing device 150*a* exerts a restoring force that causes rotation of the shaft 162*a* in the clockwise direction (indicated by an arrow 163 in FIG. 8) to move the swing arm assembly 110 inwardly (indicated by an arrow 165 in FIG. 8) towards the closed position.

The adjustment mechanism 144*a* can provide nonlinear restoring forces. The pressure applied by the debarking tool 113*a* to small diameter logs can be less than the pressure applied to large diameter logs. A force gradient can be adjusted to ensure proper processing of logs with significantly different diameters. If larger logs are not processed properly (e.g., too much bark or too little bark is removed), the reservoir device 152*a* can be used to alter the force gradient. By way of example, the reservoir devices 152*a*, 152*b* shown in FIG. 6 are in maximum volume configurations to provide a first force gradient. The reservoir device 152*c* is in an intermediate volume configuration to provide a different force gradient. The force gradients can be the measure of the change of forces (e.g., forces applied by debarking tools to logs) over a specified range, such as a range of log dimensions (e.g., diameters).

The illustrated biasing device 150*a* is an inflatable bag with two members 192*a*, 194*a* in fluid communication with each other. The members 192*a*, 194*a* can move relative to one another to accommodate displacement and rotation of a lever head 196*a*. An inflatable bag can include, without limitation, a flexible bag with one or more chambers, a bellows air bag, or the like, and can be made, in whole or in part, of one or more polymers (e.g., silicon, rubber, or the like), fabric, metal, or combinations thereof, and can provide restoring forces that vary linearly or nonlinearly with displacement. In nonlinear embodiments, the characteristics of the inflatable bag can be selected to achieve desired forces that vary with displacement. Additionally or alternatively, biasing devices can include, without limitation, hydraulic components, energy absorbers, pneumatic springs, air cylinders, or the like. For example, a biasing device can include a combination of different types of inflatable bags or can include an air cylinder.

Referring to FIG. 8, inflation limiter 188*a* is operable to change the holding capacity of the reservoir device 152*a*. The inflation limiter 188*a* includes a pusher in the form of a plate 197*a* connected to the wall 177*a* by a rod 199*a*. The plate 197*a* can be moved by rotating nuts 193*a*, 194*a* to increase or decrease the holding capacity of the inflatable device 186*a*. Other types of mechanical or electromechanical inflation limiters can also be used to reconfigure the device 186*a*, if needed or desired.

Throughout the day, a user can move the plate 197*a* any number of times. The rod 199*a* can have indicia (e.g., lines, markers, or the like) that can be used to accurately position the plate 197*a*. For example, a user can move the plate 197*a* using indicia on the rod 199*a* to locate the plate 197*a* at a known position suitable for processing a particular type of log. To process another type of log, the user can move the plate 197*a* to another position using the indicia.

Referring again to FIGS. 7 and 8, a fluid line system 260 fluidically couples the adjustment mechanisms 144 together. A user can use a pump (e.g., a hand pump, a motorized pump, etc.) to deliver pressurized air through the fluid line system 260 to pressurize the adjustment mechanisms 144*a* when the ring is stationary. When the swing arm assembly 110*a* moves away from the closed position, the biasing device 150*a* is compressed. Fluid flows through a valve 278, a line 276, and a valve 272. The fluid proceeds into the reservoir device 152*a* and radially expands the inflatable reservoir 186*a* (indicated by arrows 223, 225), while the inflatable device 186 and biasing device 150*a* cooperate to provide a restoring force to dig the debarking tool 113 into the log. Once the log exits the debarking apparatus 100, the adjustment mechanism 144*a* pushes the lever head 196*a* to rotate the shaft 162*a*. Pressurized fluid flows out of the reservoir device 152*a* and into the actuation device 150*a* as the swing arm assembly 110*a* closes.

Figure 9:
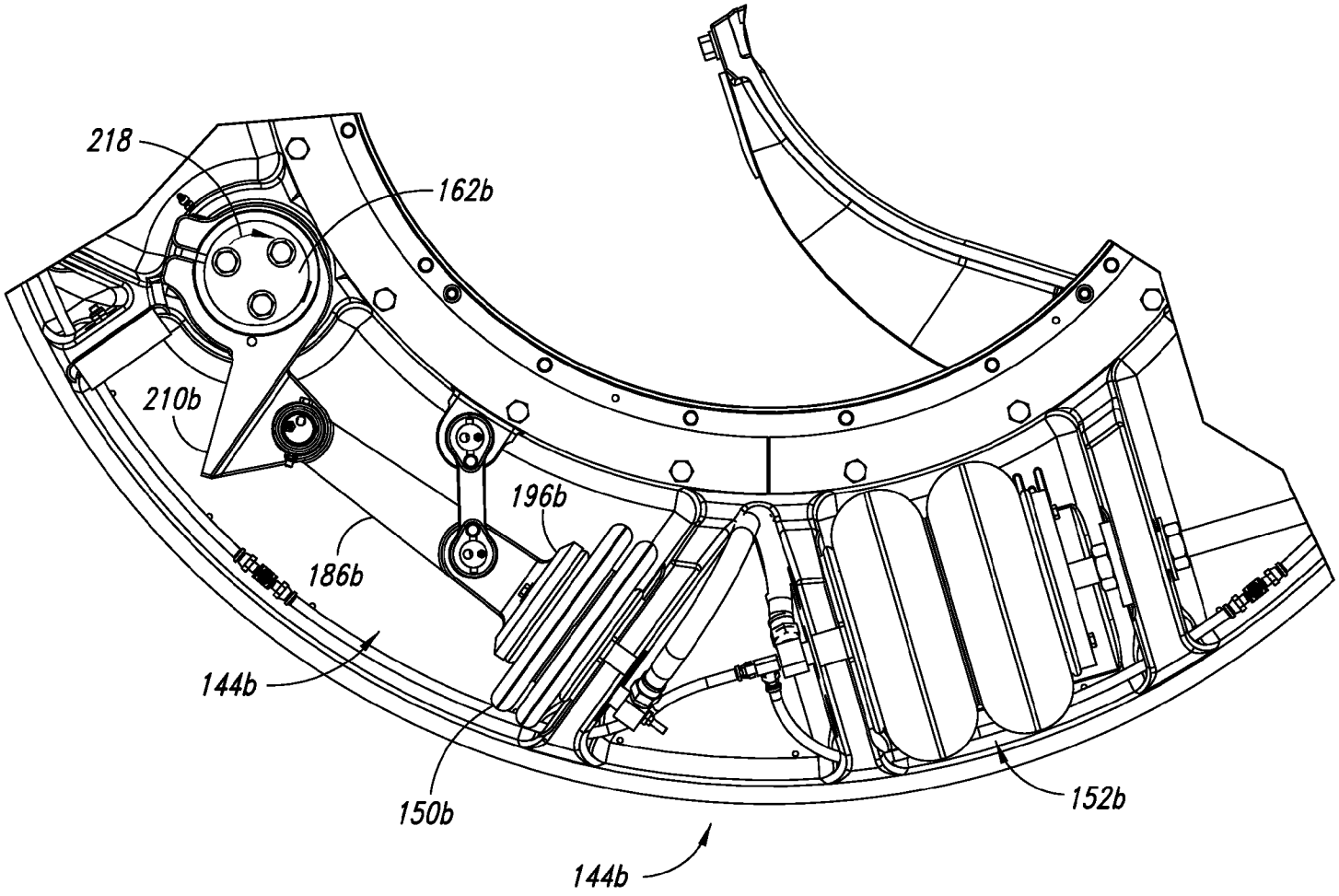
FIG. 9 is a detailed view of another force gradient adjustment mechanism of FIG. 6.

FIG. 9 shows the adjustment mechanism 144*b* when the swing arm assembly 110*b* is in a fully opened position. FIG. 5 shows the swing arm assembly 110*b* in the fully open position. The reservoir device 152*a* of FIG. 9 contains pressurized fluid that has been pushed out of the collapsed biasing device 150*b*. The reservoir device 152*a* can be distended and can maintain a desired back pressure, such that the biasing device 150*b* presses against the lever head 196*b*. As the biasing device 150*b* is reinflated, the shaft 162*b* rotates (indicated by an arrow 218 in FIG. 9) to rotate the swing arm assembly 110*b* (indicated by an arrow 219 in FIG. 5).

Figure 10:
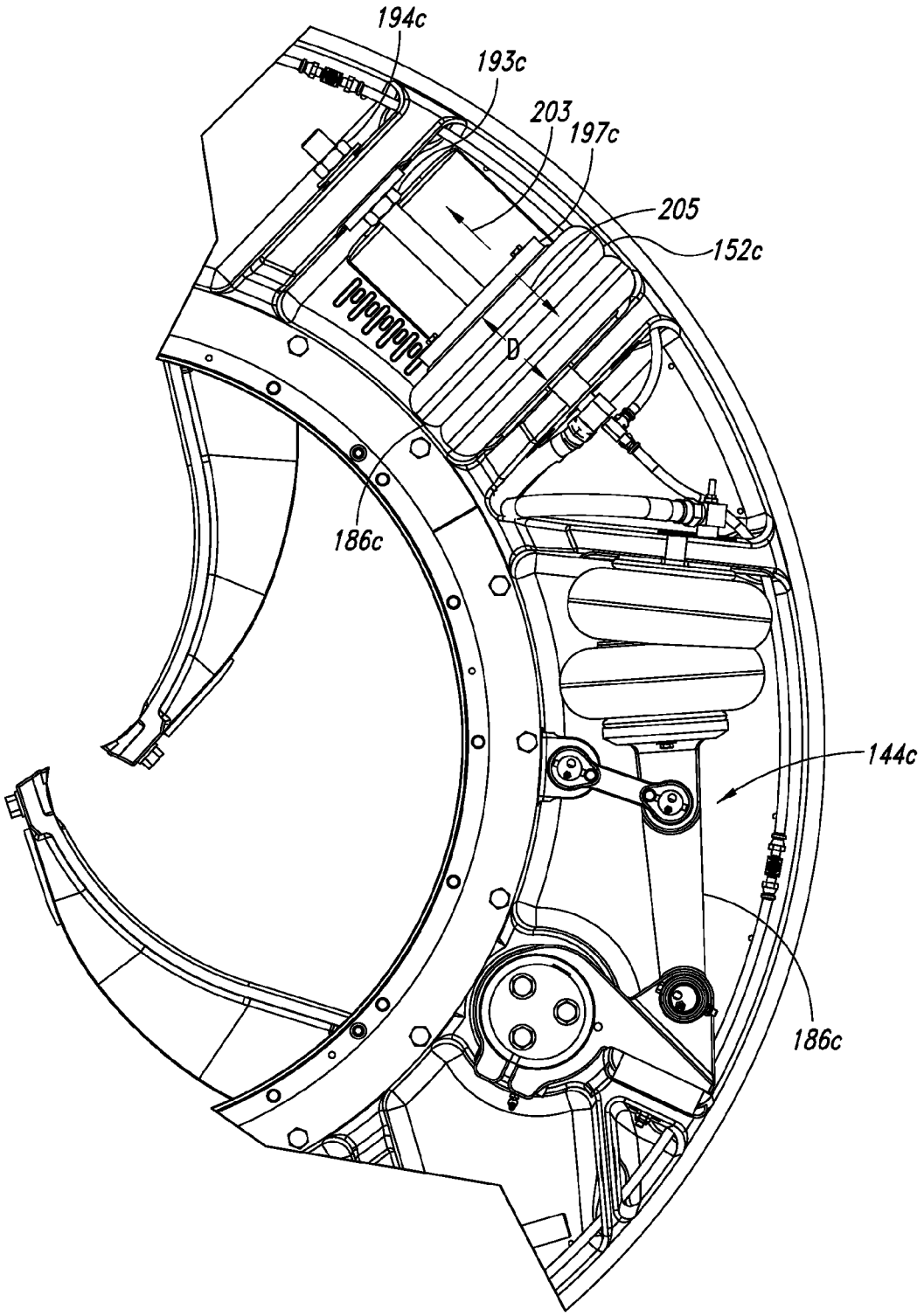
FIG. 10 is a detailed view of yet another force gradient adjustment mechanism of FIG. 6.

FIG. 10 shows the plate 197*c* holding the inflatable reservoir 186*c* in the partially collapsed configuration. A user can rotate nuts 193*c*, 194*c* to move the plate 197*c*, as indicated by arrows 203, 205, to expand or collapse the reservoir 186*c*.

Figure 11:
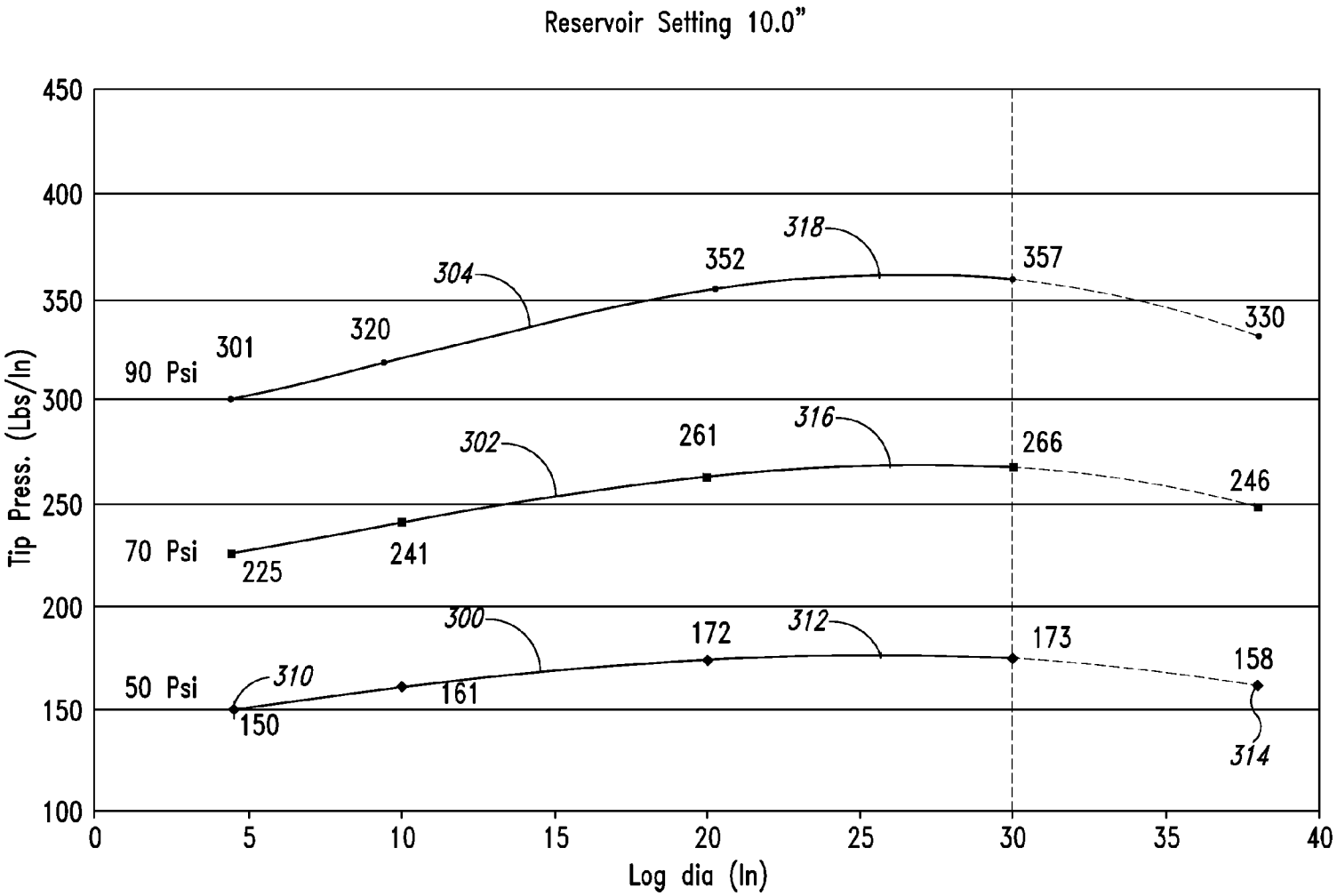
FIG. 11 is a plot of log diameters versus pressures applied by debarking tools, in accordance with one embodiment.

FIG. 11 is a graph of log diameters versus pressure exerted by debarking tools on the logs. Curves 300, 302, 304 have generally similar shapes and correspond to when a distance D (see FIG. 8) of the reservoir device 152*a* is about 10 inches. The curve 300 shows a force gradient corresponding to the adjustment mechanisms 144 containing fluid (e.g., air) at a pressure of about 50 psi. Curves 302, 304 correspond to the actuation mechanisms at initial pressures of about 70 psi, 90 psi, respectively. The force curves can be shifted upwardly or downwardly by increasing or decreasing the pressure in the adjustment mechanisms. The curvature, slope, and other characteristics of the force curves can be adjusted by altering the settings of the adjustment mechanisms. Details of the force curves 300, 302, 304 are discussed in detail below.

At 310, the debarking tool exerts a pressure of about 150 lb/inch on logs having diameters of about 5 inches. For logs having diameters equal to or larger than about 5 inches and equal to or smaller than about 25 inches, the debarking pressure slightly increases with increasing log diameters from 310 to 312. At 312, a maximum debarking pressure of about 175 lb/inch is applied by the debarking tool. A force gradient of about 17% between 310 and 312 is greater than typical non-adjustable force gradients of about 10% of conventional debarkers. For logs with diameters larger than 25 inches, the debarking pressure gradually decreases with increasing log diameters. At 314, logs having diameters of about 38 inches are processed using a debarking pressure of about 158 lb/inch. The vertical dashed line can correspond to the maximum log diameter to be processed.

A maximum debarking pressure at 316 of curve 302 is applied to logs having a diameter of about 26 inches to about 27 inches. At 316, the debarking pressure is about 270 lb/inch, resulting in a force gradient of about 20%. A maximum debarking pressure at 318 of curve 304 is applied to logs having diameters of about 26 inches to about 28 inches. At 318, the debarking pressure is about 365 lb/inch, resulting in a force gradient of about 21%. The debarker apparatus 100 can be adjusted to provide a desired force curve (e.g., curve 300, 302, or 304) selected based on, for example, the species of logs to be processed, condition of the logs, or other processing criteria.

Figure 12:
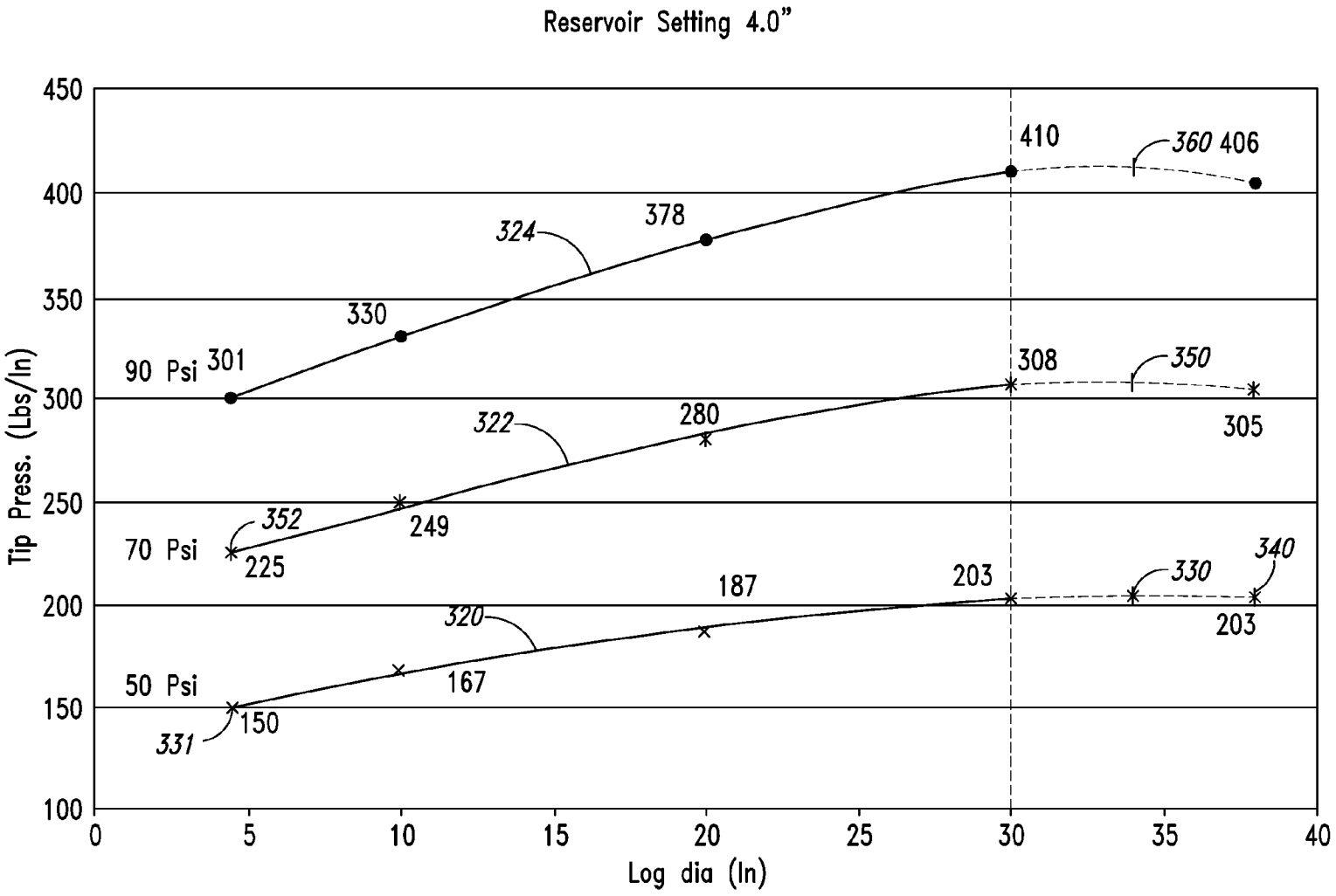
FIG. 12 is a plot of log diameters versus pressures applied by debarking tools, in accordance with another embodiment.

Curves 320, 322, 324 of FIG. 12 correspond to the adjustment mechanisms 144 at working pressures of about 50 psi, 70 psi, and 90 psi, respectively, and the distance D (see FIG. 10) at about 4 inches. A comparison shows that the curves of FIG. 11 are different from the curves of FIG. 12. The slopes of curves 300, 302, 304 are substantially less than the slopes of the curves 320, 322, 324 for smaller diameter logs. Additionally, the maximum debarking pressures of curves 320, 322, 324 are substantially larger than the maximum debarking pressures of corresponding curves 300, 302, 304. As shown in FIGS. 11 and 12, the same tip pressures are applied to 5 inch diameter logs. However, the slope of the curve 320 of FIG. 12 is greater than the slope of the curve 300 of FIG. 11. Thus, larger diameter logs are processed using a greater pressure when the reservoir device is set at a distance D of 4 inches.

The maximum pressure at 330 of curve 320 corresponds to logs having diameters of about 33 inches to about 35 inches. For logs having diameters equal to or larger than about 5 inches and equal to or smaller than about 33 inches to about 35 inches, the debarking pressure slightly increases with increasing log diameters from 332 to 330. At 330, a maximum debarking pressure of about 205 lb/inch is applied by the debarking tool. There is a force gradient of about 37% between 331 and 330. Thus, moving the plate 197 about six inches causes more than 2 times increase in force gradient for the same initial pressurization of 50 psi. For logs with diameters larger than 25 inches, the debarking pressure gradually decreases with increasing log diameters. At 340, logs having diameters of about 38 inches are processed using a debarking pressure of about 203 $lb_f$/inch.

A maximum debarking pressure about 310 $lb_f$/inch at 350 of curve 322 is applied to logs having a diameter of about 33 inches to about 35 inches. At 352, the debarking pressure is about 225 $lb_f$/inch, resulting in a force gradient of about 38%. This is almost twice as much as the force gradient of curve 302 of FIG. 11. A maximum debarking pressure at 360 of curve 324 is applied to logs having diameters of about 33 inches to 34 inches. At 360, the debarking pressure is about 420 $lb_f$/inch, resulting in a force gradient of about 40%. As such, the actuation mechanisms can be used adjust the force gradient between about 10% (when the reservoir devices are fully collapsed) and about 40%. Other ranges of force gradients are also possible, if needed or desired.

Figure 13:
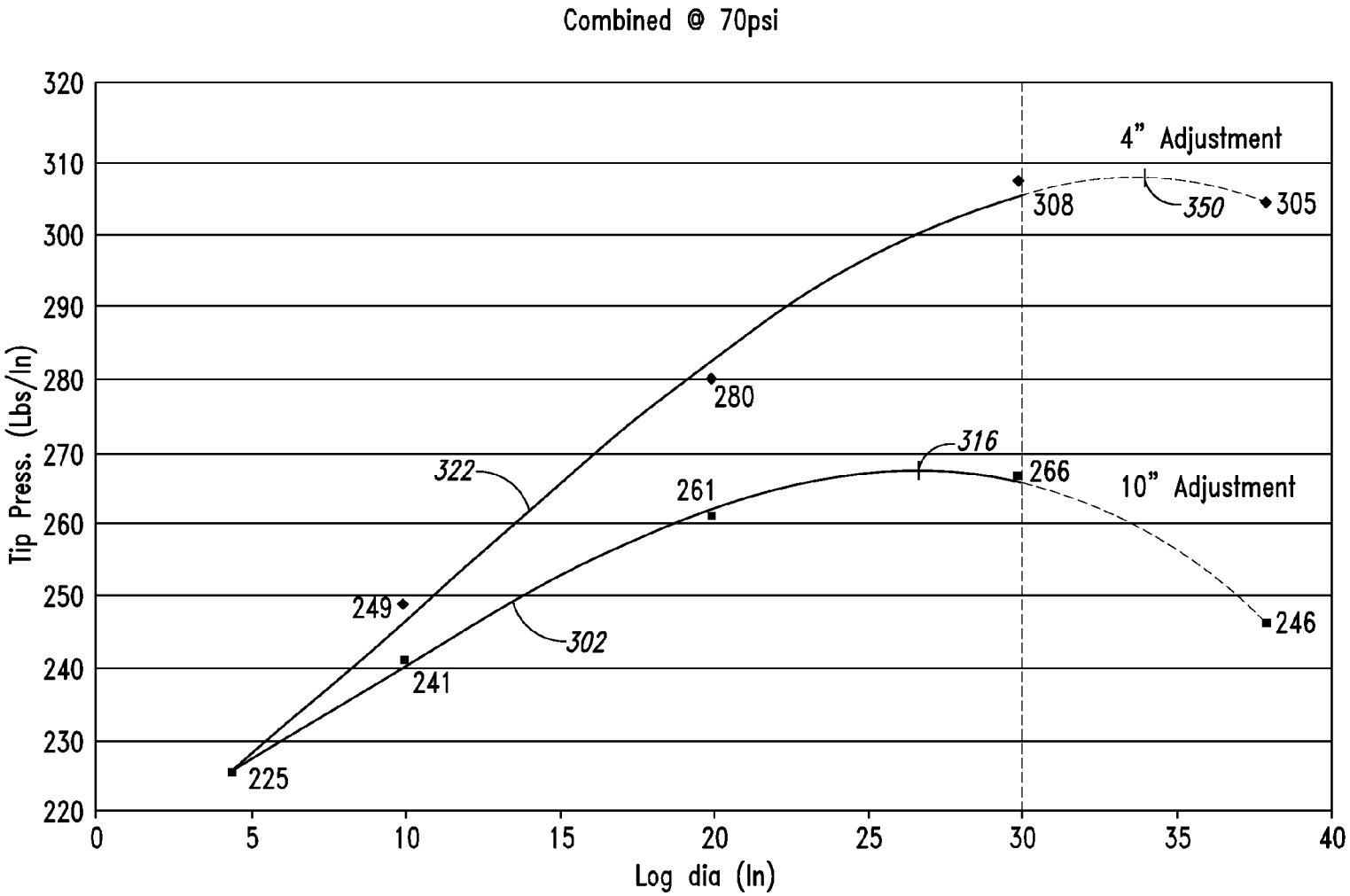
FIG. 13 is a plot of log diameters versus pressures applied by debarking tools for different settings.

The holding capacities of the force setting reservoir devices can be selectively increased or decreased to obtain the desired characteristics (e.g., force gradient, maximum tip pressure, minimum tip pressure, or the like). FIG. 13 shows force curves 302, 322 of FIGS. 11 and 12, respectively, for reservoir devices at initial pressures of about 70 psi. A curve 302 is generated when the distance D is about 10 inches. The curve 322 is generated when the distance D is about 4 inches. The slope of the curve 322 is generally greater than a slope of the curve 302 for logs with diameters smaller than 20 inches, resulting in significantly higher tip pressures for larger logs. A maximum pressure force at 316 of curve 302 is applied to logs with diameters of about 26 inches to about 28 inches. The maximum force at 382 of the curve 322 corresponds to logs having diameters of about 34 inches to about 36 inches.

To debark logs, a desired initial pressure in the adjustment mechanisms 144 can be set. Logs are then processed. The pressure levels can be adjusted until the desired amount of bark is removed. If different sized logs are under-debarked or over-debarked, pressure in the adjustment mechanisms 144 can be decreased or increased using the reservoir devices 152. This allows fine tuning of performance. One setup routine includes determining settings to debark small diameter logs (e.g., logs having diameters of about 5 inches to 10 inches). The debarker apparatus 100 is adjusted until the logs are properly debarked. Larger logs (e.g., logs with diameters greater than about 25 inches) are then debarked. The reservoir devices 152 are used to adjust the debarking pressures until the large logs are properly debarked. Thus, the initial pressure and the reservoir devices 150 are used to achieve a desired force gradient. Any size log between the small and large logs are processed with a force that is proportional to the established gradient, thus ensuring proper debarking.

Different types of force setting reservoir devices can be utilized. The reservoir device 152*a* discussed in connection with FIGS. 6-8 is illustrated as an airbag. The characteristics (e.g., holding volume, compliance, etc.) of the airbag can be selected to achieve desired force gradients, desired processing consistency desired, service life, or other design criteria. A wide range of force profiles with different gradients, maximum applied forces, or other force profile characteristics can be achieved by selecting appropriate components and ring configuration.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. A debarking apparatus, comprising:

a swing arm assembly including a debarking tool; and an air-cell ring defining an opening for receiving a log and including a force gradient adjustment mechanism coupled to the swing arm assembly, the force gradient adjustment mechanism including:

an inflatable element configured to be compressed as the swing arm assembly moves away from a closed position towards an open position, and a reservoir fluidically coupled to and in fluid communication with the inflatable element, the reservoir being reconfigurable to change a debarking force gradient, the debarking force gradient corresponding to forces applied by the debarking tool to logs having different diameters while the inflatable element and the reservoir cooperate to urge the debarking tool against the logs; and a pusher movable to adjust a volume of the reservoir.

2. The debarking apparatus of claim 1, wherein the pusher is configured to be moved with respect to the reservoir between different configurations, each configuration corresponding to a respective restoring force gradient provided by the force gradient adjustment mechanism while fluid is capable of flowing between the inflatable element and the reservoir.

3. The debarking apparatus of claim 1, wherein the pusher is movable with respect to the reservoir from a first position of a plurality of positions to hold the reservoir in a first configuration to a second position of the plurality of positions to hold the reservoir in a second configuration that is different from the first configuration.

4. The debarking apparatus of claim 1, further comprising a line coupling the reservoir to the inflatable element to allow fluid to flow from the inflatable element to the reservoir as the swing arm assembly moves towards the open position and to allow fluid to flow from the reservoir to the inflatable element as the swing arm assembly moves towards the closed position.

5. The debarking apparatus of claim 1, wherein the inflatable element is configured to be compressed as the swing arm assembly rotates away from the closed position towards the open position to cause fluid to flow out of the inflatable element and into the reservoir.

6. The debarking apparatus of claim 1, wherein the inflatable element includes at least one air bag.

7. The debarking apparatus of claim 1, wherein the swing arm assembly and the force gradient adjustment mechanism cooperate to provide large debarking forces for debarking a log with a diameter of about 20 inches that are greater than small debarking forces for debarking a log having a diameter of about 5 inches, the difference between the large and small debarking forces increases or decreases by altering the configuration of the force gradient adjustment mechanism.

8. The debarking apparatus of claim 1, wherein the swing arm assembly and the force gradient adjustment mechanism cooperate to debark relatively small diameter logs using a first debarking pressure and to debark relatively large diameter logs using a second debarking pressure, the second debarking pressure is higher than the first debarking pressure.

9. A debarking apparatus, comprising:

a swing arm assembly including a debarking tool; and a fluidically isolated ring to which the swing arm assembly is rotatably coupled, the ring including a force gradient adjustment mechanism configured to alter a gradient of a debarking force exerted by the swing arm assembly with respect to a displacement of the swing arm assembly, wherein the force gradient adjustment mechanism includes an inflatable element in fluid communication with a reservoir, and a pusher that is movable to adjust a volume of the reservoir to alter the gradient.

10. The debarking apparatus of claim 9, wherein the inflatable element is configured to provide the debarking force to urge the debarking tool carried by the swing arm assembly against a log.

11. The debarking apparatus of claim 9, wherein the pusher is movable with respect to the reservoir from a first position of a plurality of positions to hold the reservoir in a first configuration to a second position of the plurality of positions to hold the reservoir in a second configuration that is different from the first configuration.

12. The debarking apparatus of claim 9, wherein the inflatable element is configured to be pressed as the swing arm assembly rotates away from a closed position towards an open position to cause fluid to flow out of the inflatable element and into the reservoir.

13. The debarking apparatus of claim 9, wherein the swing arm assembly and the force gradient adjustment mechanism are configured to cooperate to increase the debarking force for debarking a large diameter log and decrease the debarking force for debarking a small diameter log, the increase or the decrease being selectable by altering a configuration of the force gradient adjustment mechanism.

14. The debarking apparatus of claim 9 wherein the inflatable element includes at least one air bag.

15. The debarking apparatus of claim 9 wherein the pusher includes a plate connected to an interior wall of the fluidically isolated ring by a rod.

16. The debarking apparatus of claim 15 wherein the plate can be moved with respect to the wall by rotating a nut on the rod, to adjust the volume of the reservoir.

17. The debarking apparatus of claim 9, further comprising another swing arm assembly and another force gradient adjustment mechanism including another inflatable element, another reservoir, and another pusher, the volume of the reservoir being adjustable independently of a volume of the another reservoir.

18. The debarking apparatus of claim 1 wherein the pusher includes a plate connected to an interior wall of the air-cell ring by a rod.

19. The debarking apparatus of claim 1 wherein the plate can be moved with respect to the wall by rotating a nut on the rod, to adjust the volume of the reservoir.

20. The debarking apparatus of claim 1, further comprising another swing arm assembly and another force gradient adjustment mechanism including another inflatable element, another reservoir, and another pusher, the volume of the reservoir being adjustable independently of a volume of the another reservoir.

* * * * *

UNITED STATES PATENT AND TRADEMARK OFFICE

CERTIFICATE OF CORRECTION

PATENT NO. : 9,073,233 B2
APPLICATION NO. : 13/149719
DATED : July 7, 2015
INVENTOR(S) : Marek Cholewczynski It is certified that error appears in the above-identified patent and that said Letters Patent is hereby corrected as shown below:

In the Claims

Column 10, Line 33:

"19. The debarking apparatus of claim 1 wherein the plate" should read, --19. The debarking apparatus of claim 18 wherein the plate--.

Signed and Sealed this
Twenty-ninth Day of March, 2016

Michelle K. Lee

Michelle K. Lee
*Director of the United States Patent and Trademark Office*